US007669249B2

(12) United States Patent
Blauer et al.

(10) Patent No.: US 7,669,249 B2
(45) Date of Patent: Mar. 2, 2010

(54) CONCEALABLE/DEPLOYABLE REFLECTIVE BAND FOR GARMENTS

(75) Inventors: Stephen J. Blauer, Lexington, MA (US); Toufic G. Atallah, Reading, MA (US)

(73) Assignee: Blauer Manufacturing Company, Inc., Boston, MA (US)

( * ) Notice: Subject to any disclaimer, the term of this patent is extended or adjusted under 35 U.S.C. 154(b) by 259 days.

(21) Appl. No.: 11/858,350

(22) Filed: Sep. 20, 2007

(65) Prior Publication Data

US 2008/0178363 A1 Jul. 31, 2008

Related U.S. Application Data

(63) Continuation-in-part of application No. 11/668,683, filed on Jan. 30, 2007, now Pat. No. 7,353,545.

(51) Int. Cl.
*A41D 1/00* (2006.01)

(52) U.S. Cl. ..... 2/69; 2/227; 2/115; 2/125; 2/244; 359/516; 359/518

(58) Field of Classification Search ..... 2/115, 2/125, 227, 232, 244, 69; 362/103, 108; 359/516, 518, 519
See application file for complete search history.

(56) References Cited

U.S. PATENT DOCUMENTS 982,878 A 1/1911 Rowland
1,709,799 A 4/1929 Mastin
1,805,577 A 5/1931 Freeman
1,907,482 A 5/1933 Bloch
2,030,172 A 2/1936 Kauffman
2,097,060 A 10/1937 Fierman
2,123,478 A 7/1938 Smith
3,111,681 A 11/1963 Nelson et al.
3,156,928 A 11/1964 Colignon
3,381,307 A 5/1968 Shingler
3,849,804 A 11/1974 Rakow
5,159,718 A * 11/1992 Moyer ..... 2/69
5,247,708 A 9/1993 Freese, Jr.
5,588,154 A 12/1996 Blauer et al.
6,148,442 A 11/2000 Porter
6,523,180 B1 * 2/2003 Christopher ..... 2/59
6,892,394 B2 5/2005 Grilliot et al.
6,968,573 B2 11/2005 Silver
2006/0034064 A1 2/2006 Kanzler et al.

FOREIGN PATENT DOCUMENTS

GB 2164541 A * 3/1986

* cited by examiner

*Primary Examiner*—Gary L Welch
*Assistant Examiner*—Alissa J Tompkins
(74) *Attorney, Agent, or Firm*—Steven K Martin; Altman & Martin

(57) ABSTRACT

A band that extends around a garment appendage, such as a sleeve or trouser leg. The band has a concealed position that hides a reflective tape and a deployed position where the reflective tape is visible. The band includes a strip that encircles and is attached to the garment appendage at a distance from the free end of the garment appendage. The reflective tape is bonded to the underside of the strip or to the garment appendage.

6 Claims, 4 Drawing Sheets

CONCEALABLE/DEPLOYABLE REFLECTIVE BAND FOR GARMENTS

CROSS-REFERENCES TO RELATED APPLICATIONS

The present application is a continuation-in-part application of application Ser. No. 11/668,683, filed Jan. 30, 2007 for CONCEALABLE/DEPLOYABLE REFLECTIVE BAND FOR GARMENTS in the names of Stephen J. Blauer and Toufic G. Atallah.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to clothing, more particularly, to uniforms for personnel involved in law enforcement, emergency medicine, fire and safety service, general work service, and the like.

2. Description of the Related Art

Uniforms, perhaps more than other clothing, require designs that emphasize a combination of function, comfort and style. Often in the past, these attributes have been in conflict. For example, for tactical reasons, police uniforms are dark in color. However, police personnel are often outside when it is dark and need to be seen, particularly when on or near a road, such as when dealing with a nighttime automobile crash. Consequently, solutions have been proposed for concealable reflective panels incorporated into uniforms. One solution is disclosed in U.S. Pat. No. 3,849,804. The reflective panels are attached inside the garment at the ends of the sleeves and legs. Displaying the reflective panels is a matter of folding the garment end up. One shortcoming of this method are that the sleeve and/or leg is shortened by a significant amount when folded up. Another shortcoming is that the sleeve/leg must be hemmed when the garment is manufactured, it cannot be customized for the wearer. Another solution is disclosed in U.S. Pat. No. 5,588,154. The reflective panels are attached on flaps inside pockets. Displaying the reflective panels is a matter of pulling the panels out of the pockets. One shortcoming of this method is that the uniform needs pockets where the panels are needed. Another shortcoming is that at least four panels are needed for 360° coverage about the wearer.

BRIEF SUMMARY OF THE INVENTION

The primary object of the present invention is to provide a simple, readily concealable/deployable reflective system that is visible throughout a 360° periphery about the wearer.

The present invention is a band that extends around a garment appendage, such as a sleeve or trouser leg. When the band is in the concealed position, it hides a reflective tape. When the band is in the deployed position, the reflective tape is visible.

The band of the present invention includes a cylindrical strip that completely encircles the garment appendage. When a sleeve has a buttoned cuff with a longitudinal slit and the strip is located at the slit, it is not a continuous band around the sleeve, but has free ends that overlap at the slit. The strip is attached to the appendage at a seam that is at least the width of the strip away from the free end of the garment appendage and the attachment can be by any means that is appropriate. In one form, the strip is a pleat in the appendage.

The reflective tape is bonded to the underside of the strip or to the appendage. Reflective tapes are well-known in the art. Alternatively, reflective tape is part of the strip material itself.

The strip 22 can extend in one of two opposite directions from the seam. When the strip extends in one direction, the band is in a concealed position, where the reflective tape is covered by the strip and is not visible. When the strip extends in the other direction, the band is in the deployed position, where the reflective tape is visible.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
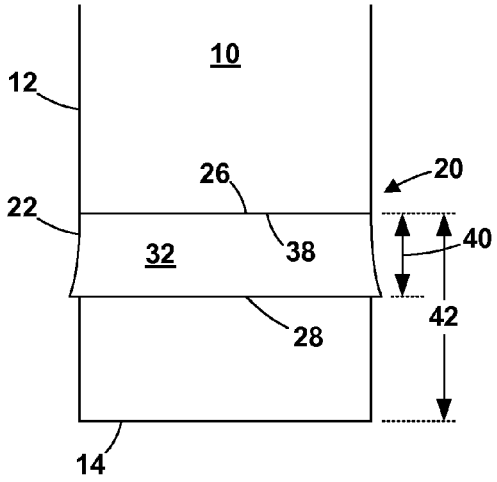
FIG. 1 is a view of one embodiment of the present invention on a trouser leg in the concealed position.

The present invention is a band that extends around the appendage of a garment, such as a sleeve or trouser leg. When the band is in the concealed position, it hides a reflective tape. When the band is in the deployed position, the reflective tape is visible.

The present invention can be employed on any garment appendage, such as a jacket or shirt sleeve or a trouser leg. The relevant common aspect of the sleeve and trouser leg is that they are fabric cylinders that have a free end, such as a cuff. The cylindrical garment appendage can be produced in any number of ways, all of which are known in the art.

The band 20 of the present invention is shown in the figures. A cylindrical strip 22, typically made from the same material as the garment 10, fully encircles the garment appendage 12. One edge 26 of the strip 22 is attached to the garment appendage 12 at a seam 38 that is at least the width 40 of the strip 22 away from the free end 14 of the garment appendage 12, as at 42 in FIG. 1. On a trouser leg, the preferred location is from just below the knee to the trouser leg hem. The lower portion of the leg is a very effective location because automobile headlights point down towards the road and the feet tend to move more than the torso. On a long sleeve or short sleeve, the strip 22 is preferably located between the shoulder and the elbow.

FIGS. 6-9 illustrate another embodiment of the present invention. When a sleeve 12 has a buttoned cuff 60, there is a longitudinal slit 62 in the fabric of the sleeve 12. Consequently, if the strip 22 is located at the slit 62, it is not a continuous band around the sleeve 12; it has free ends 66, 68 that overlap at the slit 62 to appear nearly like a continuous band.

Figure 10:
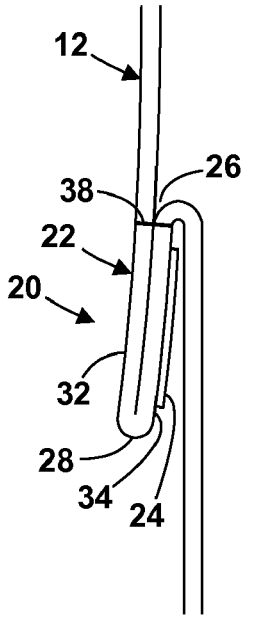
FIG. 10 is an enlarged cross-section of a portion of a trouser leg incorporating the present invention showing a first method of attachment.
Figure 11:
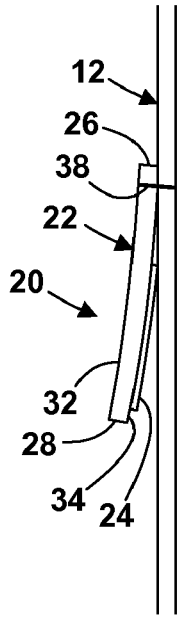
FIG. 11 is an enlarged cross-section of a portion of a trouser leg incorporating the present invention showing a second method of attachment.

The attached edge 26 of the strip 22 is attached in any manner that is appropriate by, for example, sewing, heat sealing, or adhesive. In one form, the strip 22 is a pleat in the garment appendage 12, as shown in detail in FIG. 10. The appendage material is folded to produce the strip 22 around the garment appendage 12 and is fixed by sewing across a seam 38. In other words, the strip 22 is not a separate item but is produced by merely folding and sewing the garment appendage 12. The result is that the strip 22 is composed of two layers of the garment material. Alternatively, the two layers of garment material are heat-sealed together, remaining separated at the seam 38. Alternatively, the strip 22 is a separate piece of material that is sewn to the garment appendage 12 at the attached edge 26 to form the seam 38, as shown in FIG. 11. The strip 22 can be composed of one or more layers of material.

Figure 12:
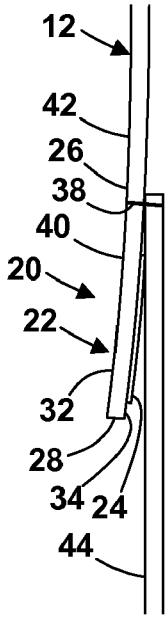
FIG. 12 is an enlarged cross-section of a portion of a trouser leg incorporating the present invention showing a third method of attachment.

Alternatively, as shown in FIG. 12, the strip 22 is the bottom end 40 of an upper portion 42 of the garment appendage 12 and the lower portion 44 of the garment appendage 12 is sewn to the upper portion 42 inwardly from the bottom end 40 of the upper portion 42 to form the seam 38.

Figure 13:
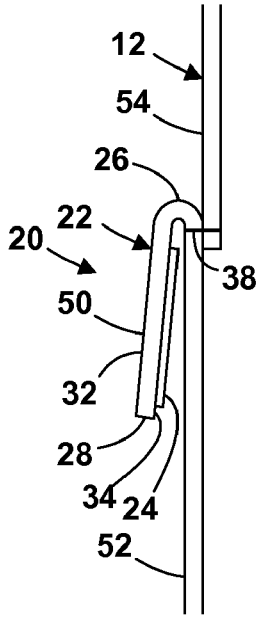
FIG. 13 is an enlarged cross-section of a portion of a trouser leg incorporating the present invention showing a fourth method of attachment.

Alternatively, as shown in FIG. 13, the strip 22 is the top end 50 of a lower portion 52 of the garment appendage 12 and the upper portion 54 of the garment appendage 12 is sewn to the lower portion 52 inwardly from the top end 50 of the lower portion 54 to form the seam 38.

Figure 2:
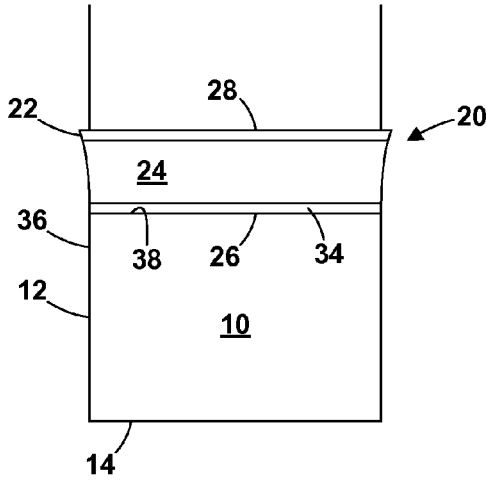
FIG. 2 is a view of one configuration of the embodiment of FIG. 1 in the deployed position.
Figure 3:
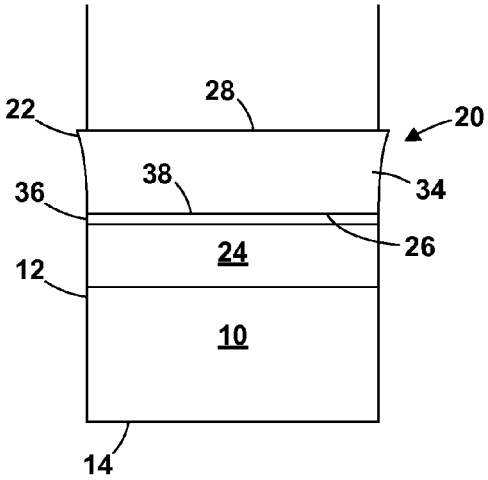
FIG. 3 is a view of another configuration of the embodiment of FIG. 1 in the deployed position.
Figure 5:
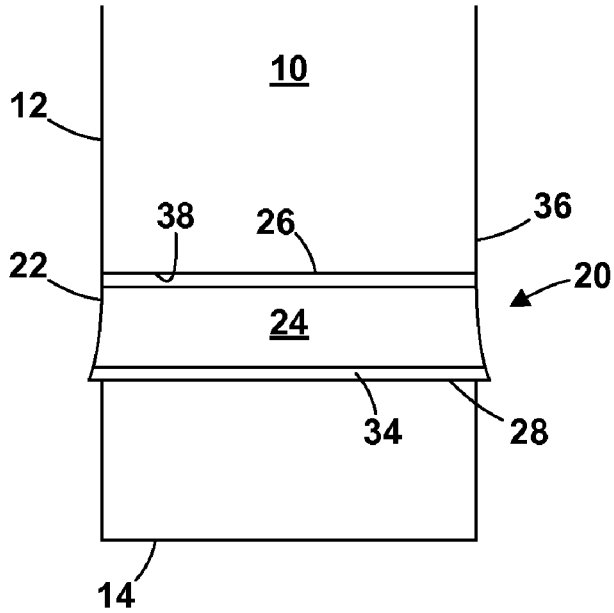
FIG. 5 is a view of one configuration of the embodiment of FIG. 4 in the deployed position.
Figure 8:
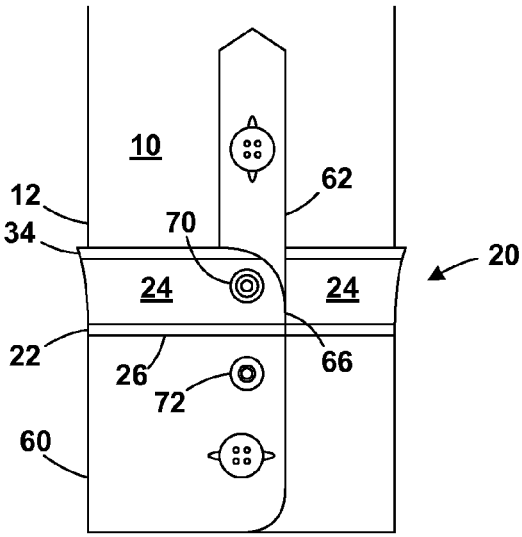
FIG. 8 is a view of a configuration of the embodiment of the FIG. 6 in the deployed position.
Figure 9:
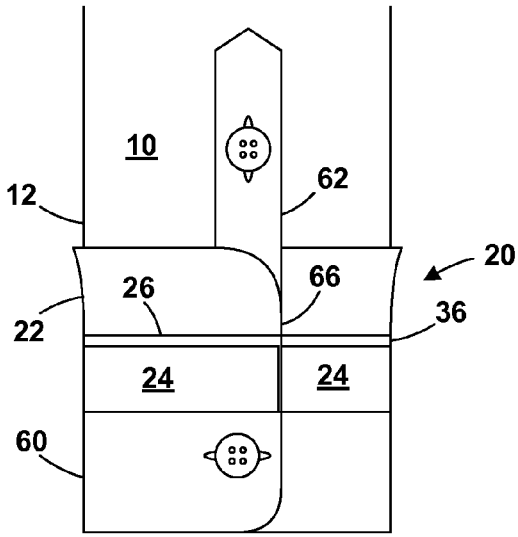
FIG. 9 is a view of another configuration of the embodiment of FIG. 6 in the deployed position.

The reflective tape 24 is bonded to the underside of the strip 22, as in FIGS. 2, 5, and 8 or to the garment appendage 12, as in FIGS. 3 and 9. Reflective tapes 24 are well-known in the art, and there are a variety of types, any of which is contemplated for use with the present invention. Examples include transfer films, reflective fabrics, high-gloss materials, and inks. Transfer films are composed of retroreflective lenses bonded to a heat-activated adhesive that may be heat laminated to a fabric. Reflective fabrics are composed of retroreflective lenses bonded to a fabric backing that can be easily sewn onto other fabrics. High-gloss materials are composed of microprisms bonded to a flexible, glossy, UV-stabilized polymeric film and can be sewn or radio/high frequency (RF or HF) welded to compatible fabrics. Inks are composed of a water-based ink base combined with retroreflective lenses and are screen printed onto fabrics.

Alternatively, the strip 22 is the reflective tape 24, that is, the reflective tape 24 is not a separate component bonded to the strip 22 but is part of the strip material itself.

The strip 22 can extend in one of two opposite directions from the attached edge 26, both along (parallel to and coaxial with) the garment appendage 12. When the strip 22 extends in one of the two directions, the band 20 is in a concealed position. When the strip 22 extends in the other direction, the band 20 is in the deployed position. The strip 22 is moved between the two positions manually, as one would cuff the end of a shirt sleeve or trouser leg.

Figure 4:
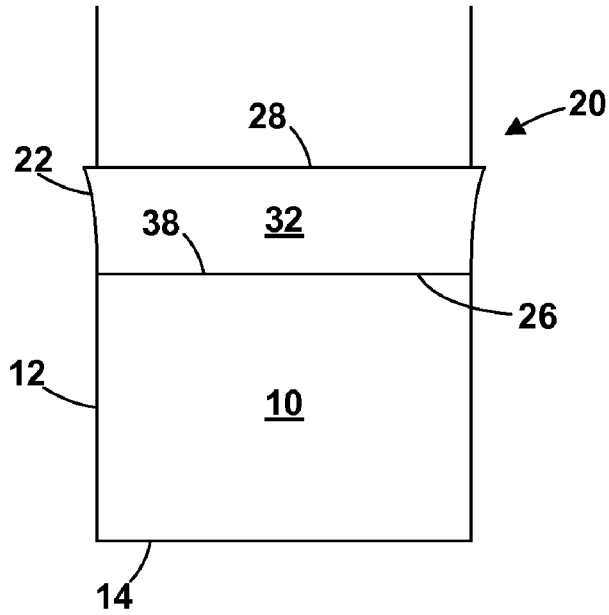
FIG. 4 is a view of another embodiment of the present invention in the concealed position.
Figure 6:
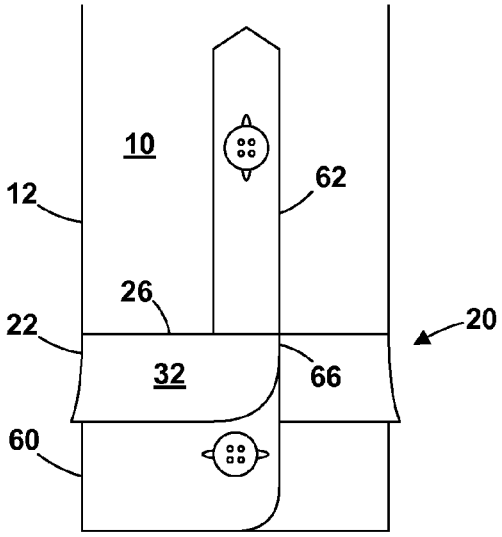
FIG. 6 is a view of another embodiment of the present invention in the concealed position.
Figure 7:
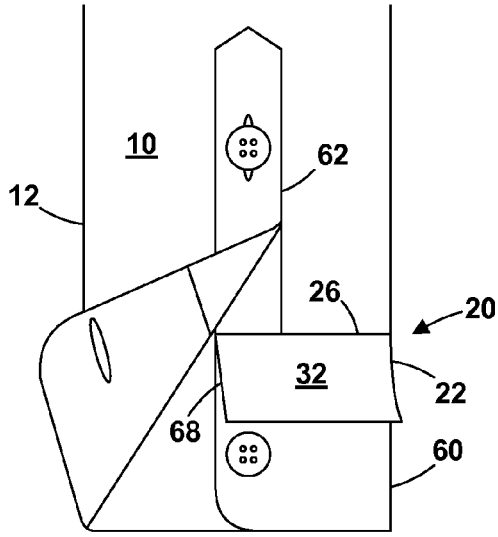
FIG. 7 is another view of the embodiment of the FIG. 6.

In the concealed position, the reflective tape 24 is covered by the strip 22 so that it is not visible. In FIGS. 1 and 6, the band 20 is in the concealed position when the strip 22 extends downwardly from the attached edge 26. In FIG. 4, the band 20 is in the concealed position when the strip 22 extends upwardly from the attached edge 26. The outer surface 32 of the strip 22, which is typically the same color as the garment material, is exposed so that the strip 22 blends in with the garment appendage 12.

In the deployed position, the reflective tape 24 is visible. In FIGS. 2, 3, 8, and 9, the band 20 is in the deployed position when the strip 22 is extends upwardly from the attached edge 26. In FIG. 5, the band 20 is in the deployed position when the strip 22 extends downwardly from the attached edge 26. In either case, the under surface 34 of the strip 22 and the portion 36 of the garment appendage 12 that was underneath the strip 22 is exposed.

When in the deployed position of FIGS. 2, 3, 8, and 9 or the concealed position of FIG. 4, that is, when the strip 22 is extending upwardly against gravity, the elastic nature of the fabric permits the strip 22 to deform to move it to that upwardly-extended position. The strip 22 stays in the upwardly-extended position until manually moved to the downwardly-extended position because the free edge 28 of the strip 22 has approximately the same circumference as that of the garment appendage 12.

Optionally, the under surface 34 of the strip 22 is removably secured to the garment appendage 12 to retain the strip 22 in the desired position. One method of removably securing the strip 22 is by using microhook/microloop patches, one version of which is sold under the brand name VELCRO. Another securing method employs mating snap components 70, 72, as in FIG. 8, where the snap will retain the strip 22 in the concealed position. One snap component 70 is located on the strip 22 and the other snap component 72 is located on the appendage 12. When the strip 12 is in the concealed position, the snap components 70, 72 can be fastened to each other. Yet another method employs buttons. Securing the under surface 34 can prevent the reflective tape 24 from becoming accidentally exposed.

The reflective tape 24 needs to be wide enough to be effectively visible when the band 20 is in the deployed position. In the configuration of FIGS. 2, 5, and 8, if the strip 22 is too narrow, the reflective tape 24 will not be wide enough to be effectively visible. In the configuration of FIGS. 3 and 9, if the strip 22 is too narrow, the reflective tape 24 will not be covered when in the concealed position. If the strip 22 is too wide, it may not stay in the upwardly extended position, but may droop downwardly with gravity, rendering it ineffective by either covering or exposing the reflective tape 24 when not desired. Typically, the strip 22 will be from ⅜ inch to as much as three inches wide and the reflective tape 24 will be a bit narrower.

Thus it has been shown and described a concealable/deployable reflective band for garments which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A garment appendage comprising:

(a) a cylindrical appendage composed of a fabric and having a free end and a longitudinal slit;

(b) a strip having an attached edge, a free edge, a width therebetween, and two free ends, said strip completely encircling said appendage at said longitudinal slit such that said two strip free ends overlap at said longitudinal slit, said strip attached to said appendage at said attached edge to form a seam at least said width distance from said appendage free end;

(c) a reflective tape encircling said appendage;

(d) said strip having a concealed position wherein said strip extends in a first direction along said appendage and wherein said reflective tape is hidden; and (e) said strip having a deployed position wherein said strip extends in a second direction generally opposite said first direction and along said appendage and wherein said reflective tape is exposed.

2. The garment appendage of claim 1 wherein said reflective tape is attached to said strip.

3. The garment appendage of claim 1 wherein said reflective tape is attached to said appendage.

4. The garment appendage of claim 1 wherein said strip is composed of said fabric.

5. The garment appendage of claim 1 further comprising a temporary fastener component on said appendage and a mating temporary fastener component on said strip, said components being located such that said temporary fastener components can be fastened together when said strip is in said concealed position.

6. The garment appendage of claim 5 wherein said temporary fastener components are snap components.

* * * * *